US009559467B1

(12) United States Patent
Khorrami et al.

(10) Patent No.: US 9,559,467 B1
(45) Date of Patent: Jan. 31, 2017

(54) CONNECTOR ASSEMBLY WITH RELIABLE ELECTRICAL CONNECTION

(71) Applicant: FOXCONN INTERCONNECT TECHNOLOGY LIMITED, Grand Cayman (KY)

(72) Inventors: Kamyar Khorrami, Orange, CA (US); Samuel Mace, Halifax, PA (US); Michael McKee, Camp Hill, PA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/828,433

(22) Filed: Aug. 17, 2015

(51) Int. Cl.
*H01R 13/6581* (2011.01)
*H01R 13/629* (2006.01)

(52) U.S. Cl.
CPC .... *H01R 13/6581* (2013.01); *H01R 13/62933* (2013.01)

(58) Field of Classification Search
USPC ... 439/607.04, 310, 271, 579, 589, 485, 856
See application file for complete search history.

(56) References Cited

U.S. PATENT DOCUMENTS 5,087,211 A * 2/1992 Prunier ..... H01R 12/777 439/579
5,431,576 A * 7/1995 Matthews ..... H01R 13/113 439/247
6,178,106 B1 * 1/2001 Umemoto ..... H01R 11/12 363/146
7,581,972 B2 * 9/2009 Daamen ..... H01R 13/6315 439/249
7,766,706 B2 * 8/2010 Kawamura ..... H01R 13/112 439/833
7,789,690 B1 * 9/2010 Rhein ..... H01R 13/53 439/310
9,153,887 B2 * 10/2015 Chen ..... H01R 12/7088
9,190,756 B2 * 11/2015 Glick ..... H01R 13/18
2003/0049976 A1 * 3/2003 Kato ..... H01R 13/187 439/856
2009/0035990 A1 * 2/2009 McCarthy ..... H01R 9/0518 439/585
2009/0197466 A1 * 8/2009 Cheng ..... H01R 12/7088 439/589
2013/0109224 A1 * 5/2013 Chin ..... H01R 12/7088 439/485
2013/0323954 A1 * 12/2013 Eckel ..... H01R 13/5219 439/271
2014/0273659 A1 * 9/2014 Glick ..... H01R 13/113 439/676
2015/0038024 A1 * 2/2015 Glick ..... H01R 13/18 439/862

* cited by examiner

*Primary Examiner* — Alexander Gilman
(74) *Attorney, Agent, or Firm* — Wei Te Chung; Ming Chieh Chang

(57) ABSTRACT

An connector assembly includes a male connector (100) having a male housing (10) and a plurality of male contacts (12); and a female connector (200) for mating with said male connector including a female housing (20) and a plurality of female contacts (21) retained in said female housing. Each female contact defines a pair of mating plates (211) spaced away from each other for said male contact locating therebetween. Each pair of said mating plates (211) have a pair of spring leaves (22) connecting therewith and defining a plurality of spring fingers (221) resiliently clamping the corresponding male contact (12) therebetween.

18 Claims, 19 Drawing Sheets

CONNECTOR ASSEMBLY WITH RELIABLE ELECTRICAL CONNECTION

BACKGROUND OF THE INVENTION

1. Field of the Invention

The present invention relates to a connector assembly for transmitting high-voltage power or the like.

2. Description of Related Art

The connector assembly for transmitting high-voltage (HV) power is widely used in hybrid, battery and/or fuel-cell vehicles, and connected electrically to devices such as batteries, electric motors, etc. The connector assembly comprises a male connector connecting to a cable and a female connector mounted onto a PCB, the male connector and the female connector join together to transfer high-voltage energy between different components of the vehicle. High-voltage power transmission is very dangerous when a poor contact occurs between the male connector and female connector, thus it is very important and necessary to ensure a reliable electrical connection between the male connector and the female connector.

Hence, a connector assembly with reliable electrical connection is desired to improve those disclosed in the aforementioned proposal.

SUMMARY OF THE INVENTION

According to one aspect of the present invention, a connector assembly comprises a male connector including a male housing and a plurality of male contacts for connecting to electric cables; a female connector for mating with said male connector including a female housing and a plurality of female contacts retained in said female housing. Each female contact defines a pair of mating plates spaced away from each other to sandwich said male contact therebetween. A pair of spring leaves each defining a plurality of spring fingers are located between the respective male contacts and mating plates of the female contact.

According to another aspect of the present invention, a female connector comprises a female housing defining a pair of chambers; a pair of female contacts retained in said female housing and accommodated in said pair of chambers respectively, each female contact having a pair of mating plates protruding into the corresponding chamber and spaced from each other in a face-to-face manner; and a pair of planar spring leaves coupled to each pair of said mating plates. Each one of said pair of spring leaves comprise a plurality of spring fingers relaying on inner sides of the corresponding mating plates and protruding toward another of said pair of spring leaves.

Other objects, advantages and novel features of the invention will become more apparent from the following detailed description when taken in conjunction with the accompanying drawings.

Figure 6:
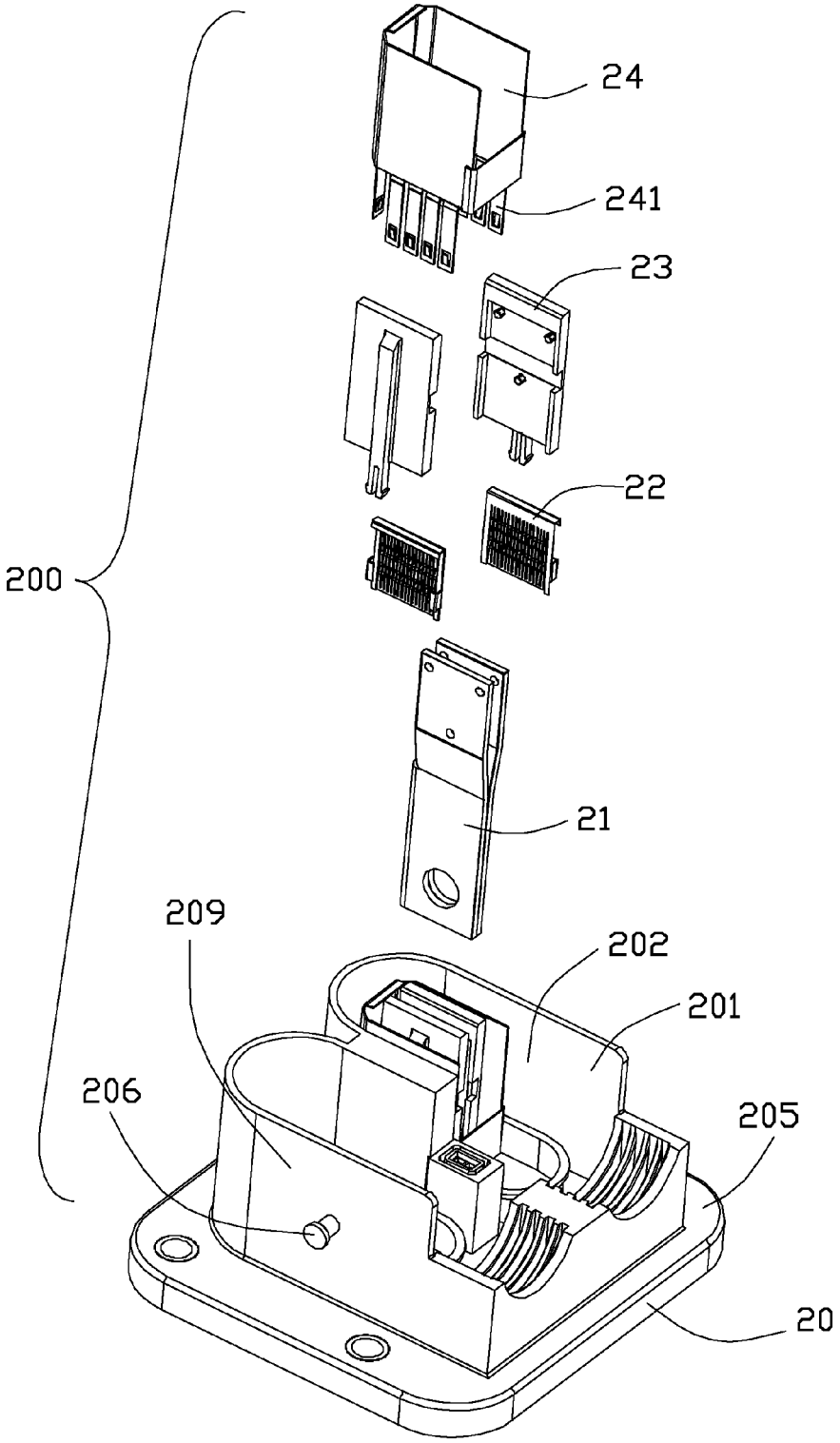
FIG. 6 is a partly exploded view of the female connector of FIG. 1.

FIG. Bis another perspective view of FIG. 6.

Figure 1:
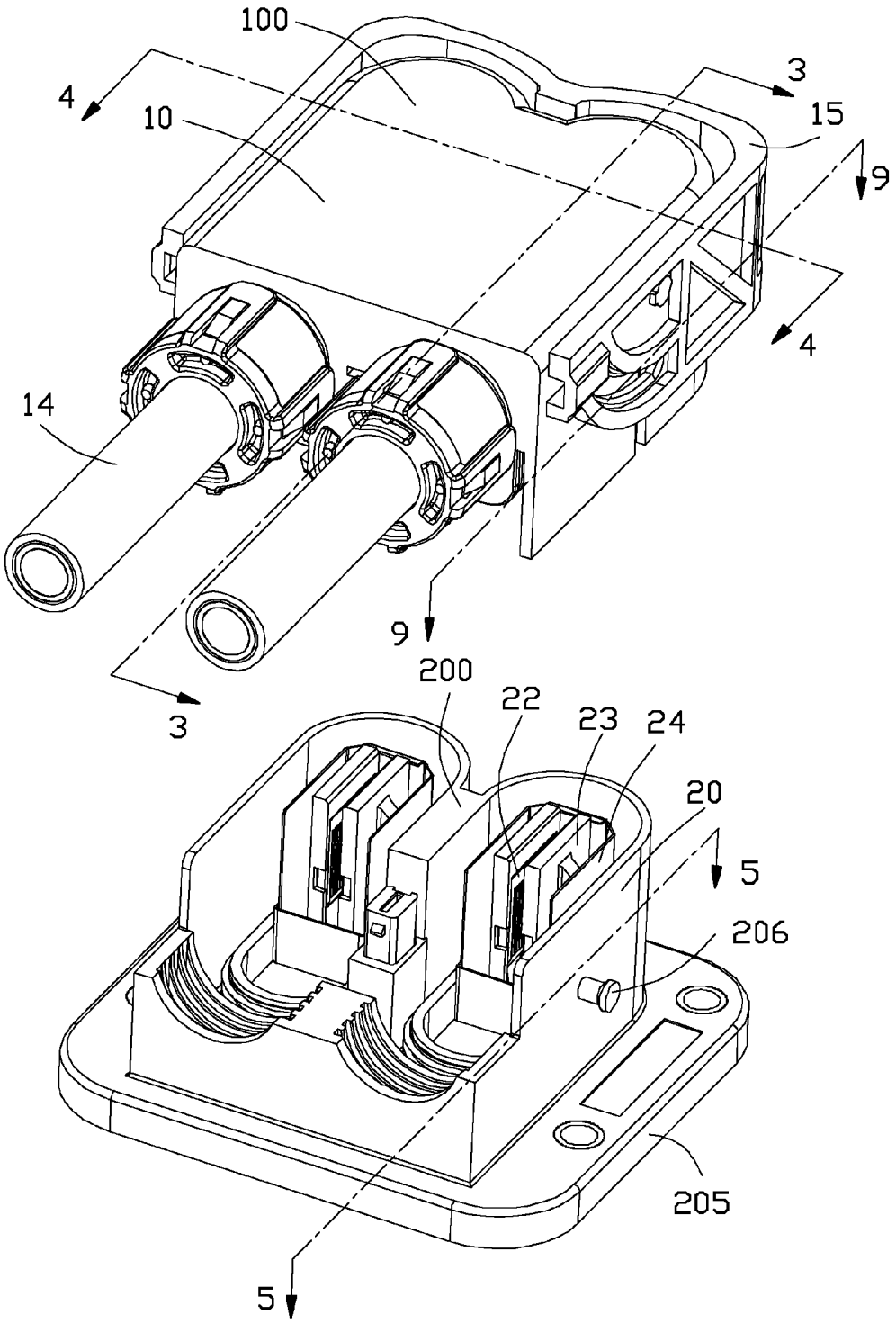
FIG. 1 is a perspective view of an unmated connector assembly in accordance with an embodiment of the present invention.
Figure 9:
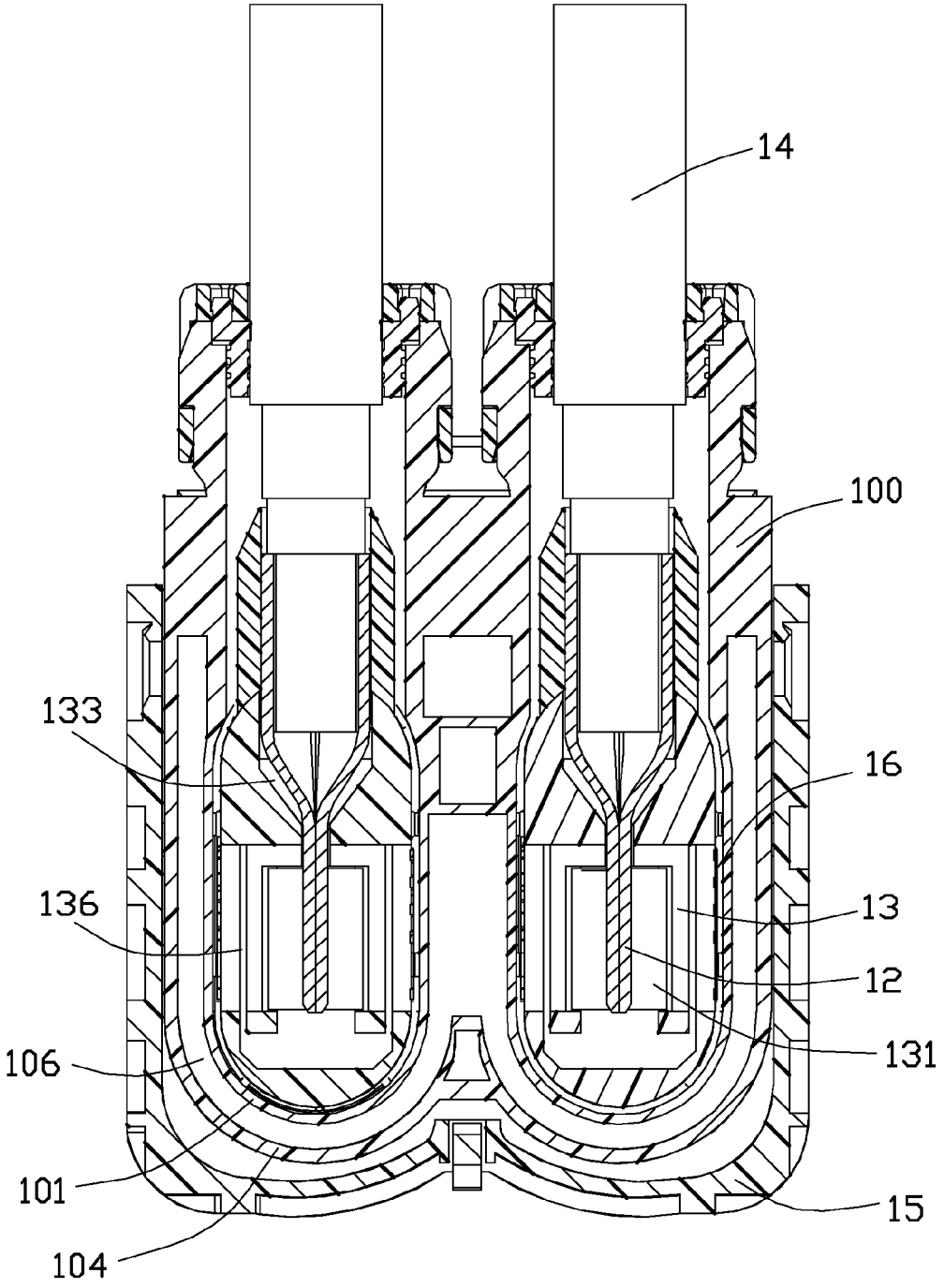

FIG. 9 is a cross-sectional view of the male connector taken along line 9-9 show in FIG. 1.

Figure 10:
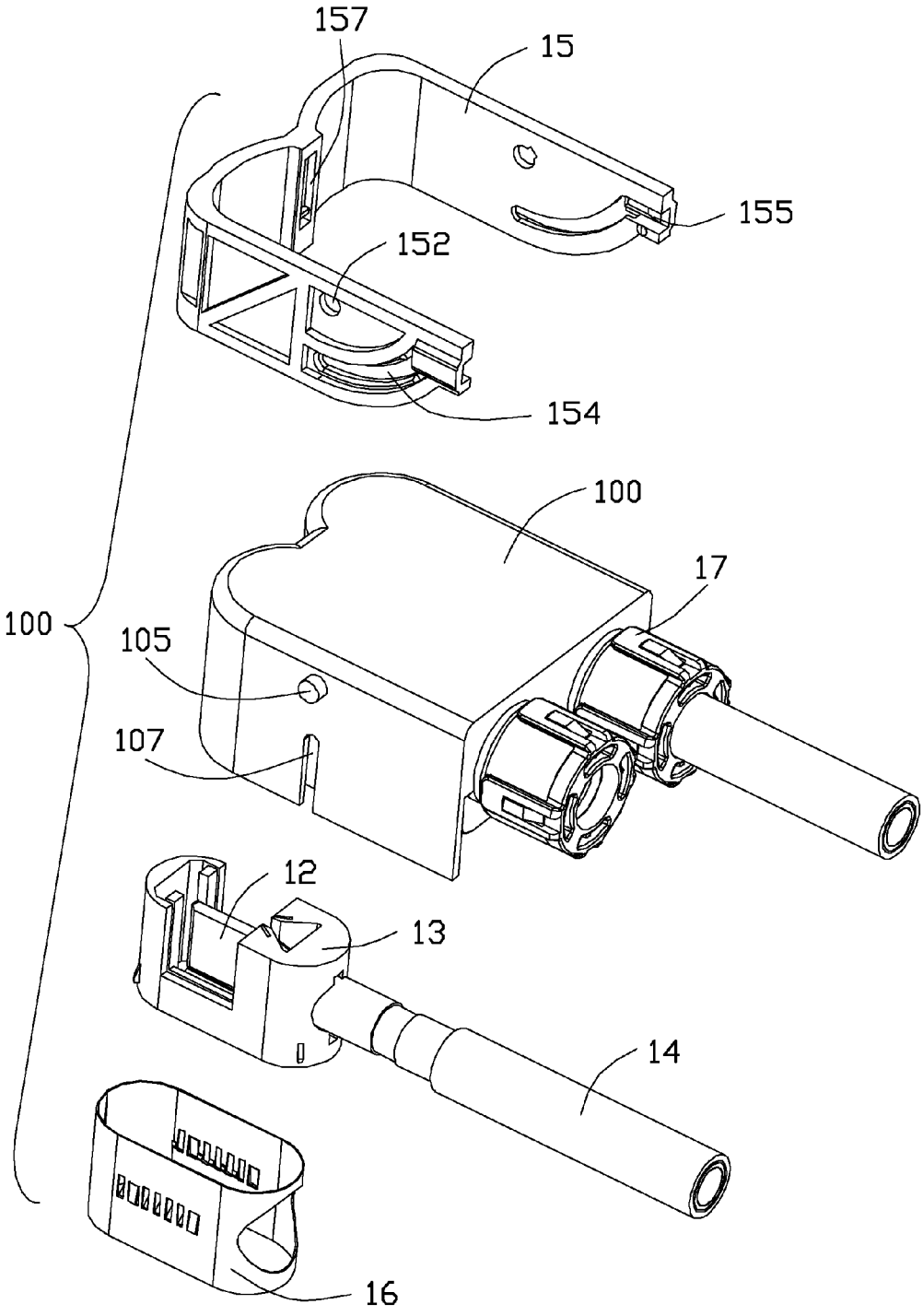

FIG. 10 is a partly exploded view of the male connector shown in FIG. 1.

Figure 11:
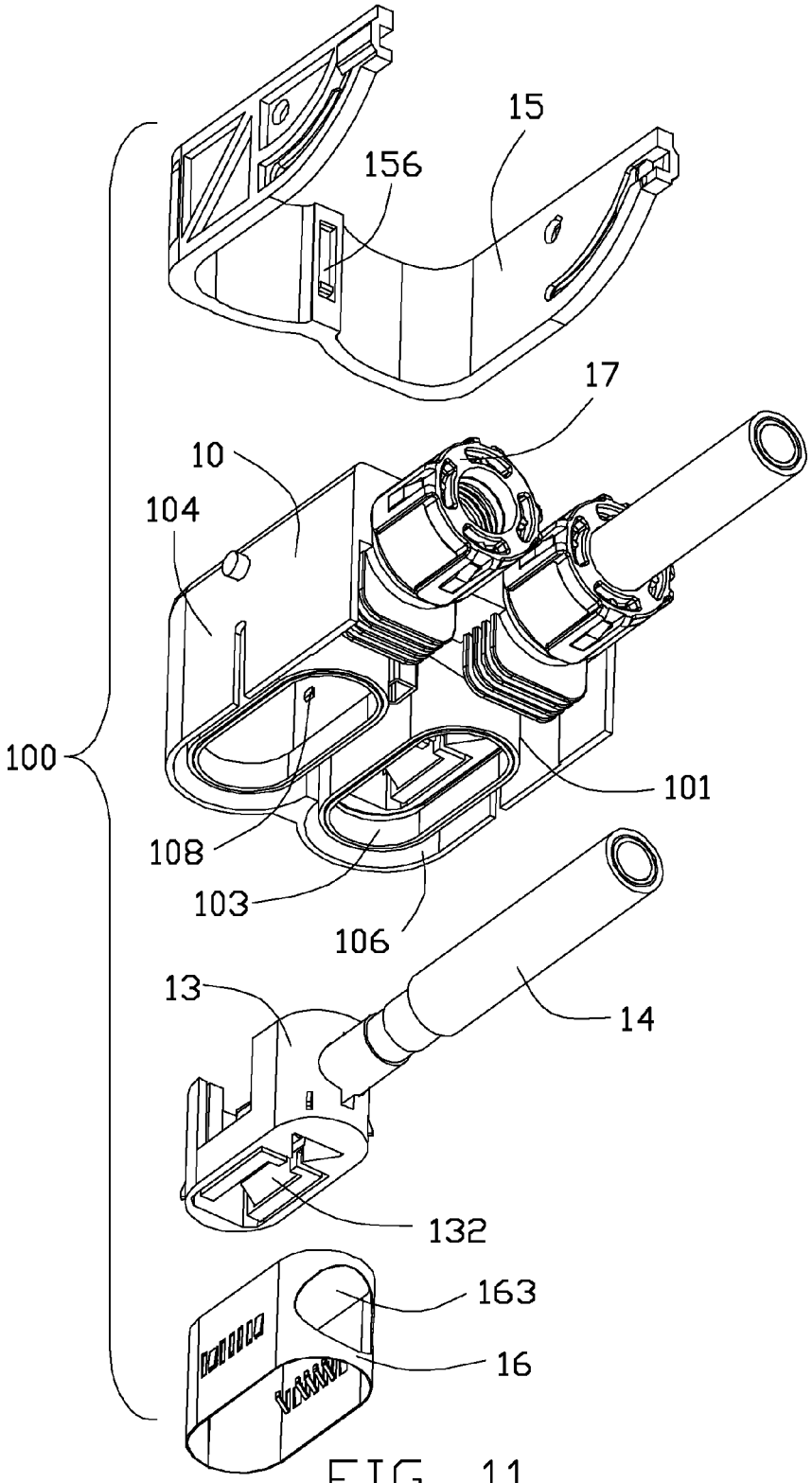

FIG. 11 is another perspective view of FIG. 10.

Figure 12:
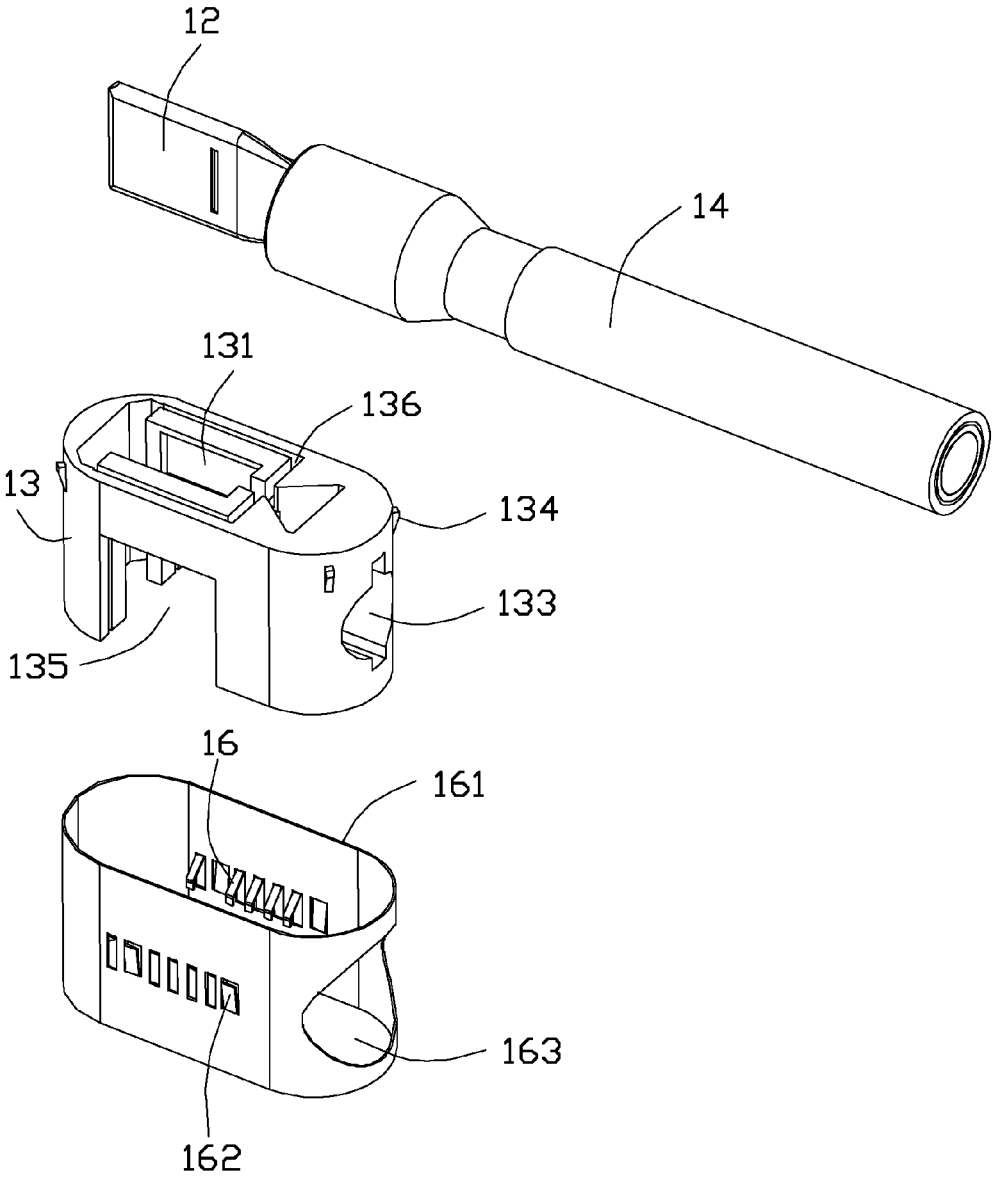

FIG. 12 is a partly enlarged perspective view of the male connector of FIG. 10, while taken from another aspect.

Figure 7:
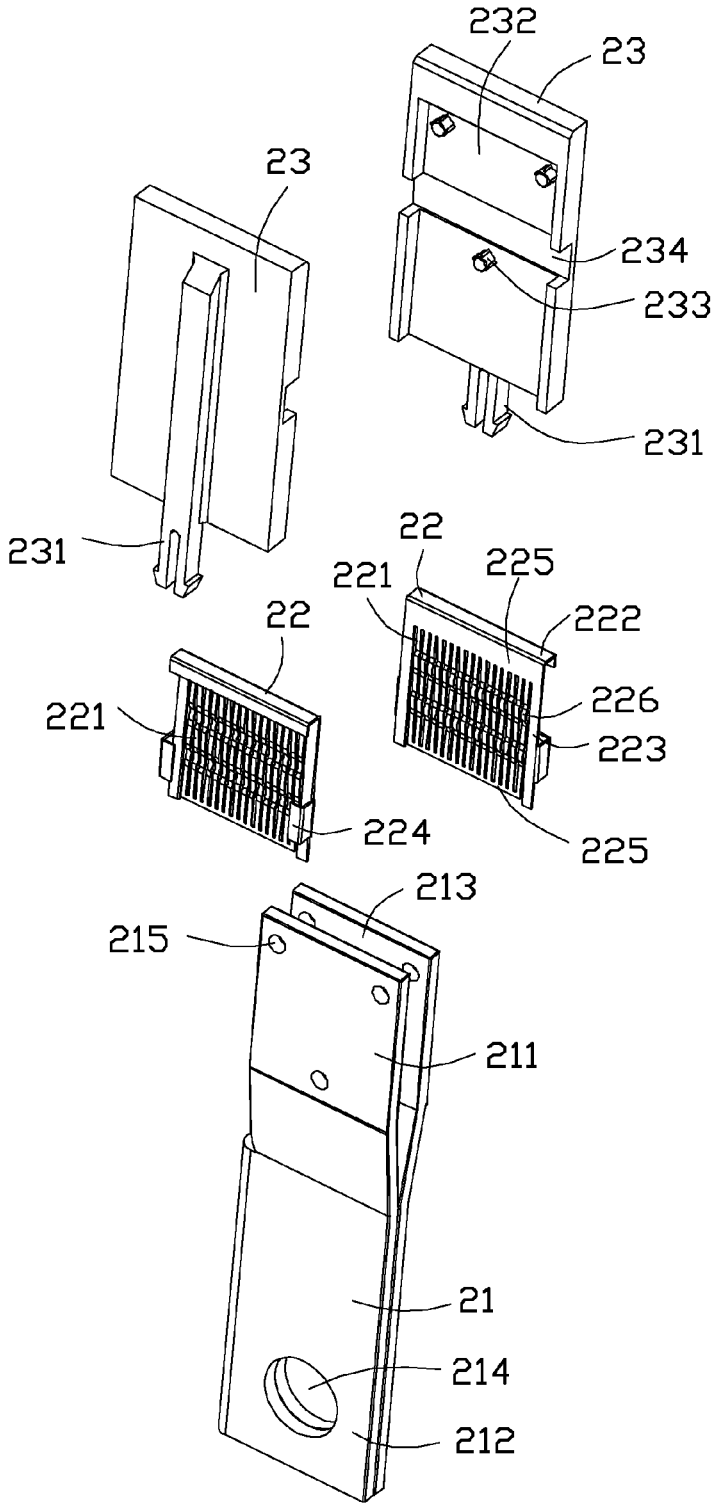
FIG. 7 is a partly enlarged perspective view of FIG. 6.
Figure 8:
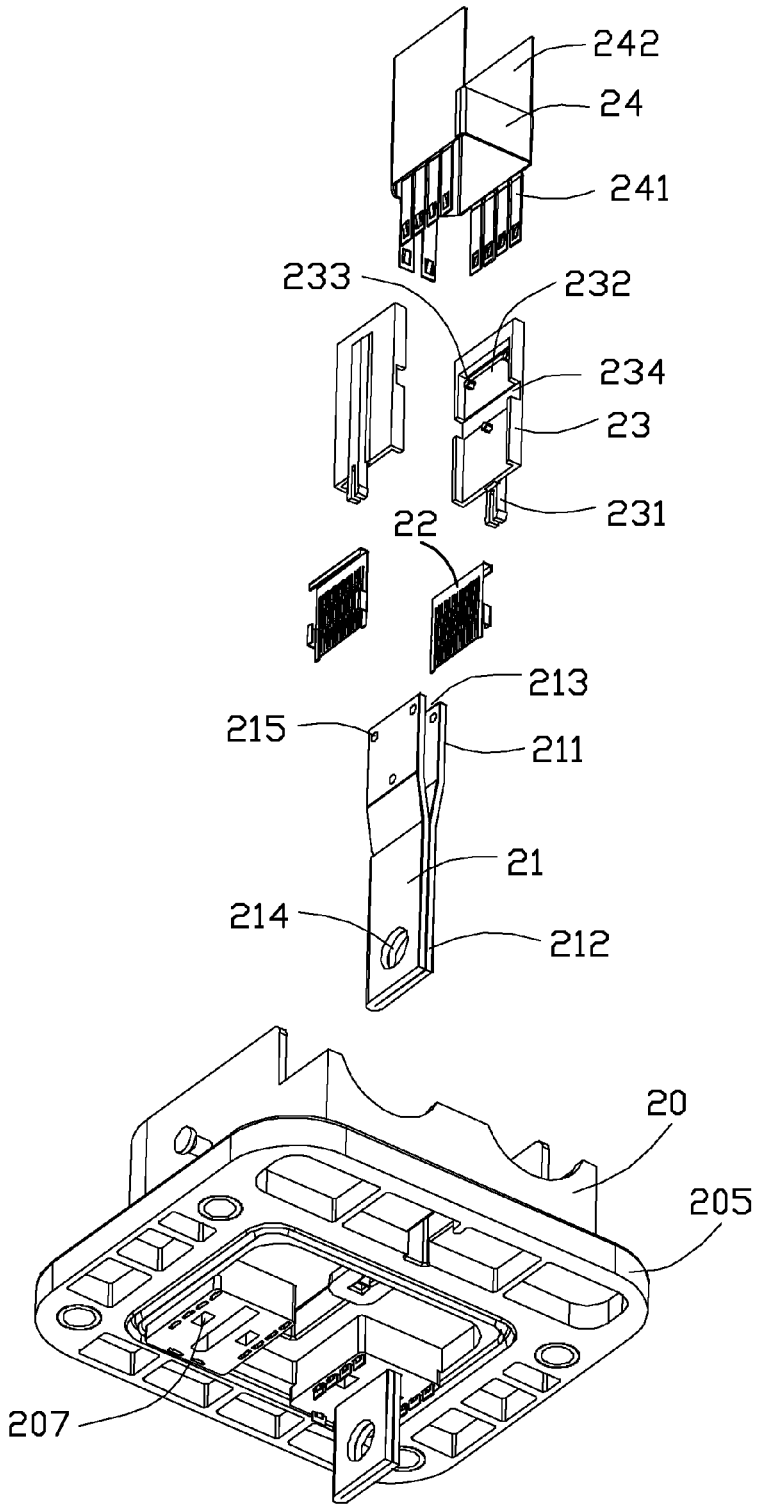
Figure 13:
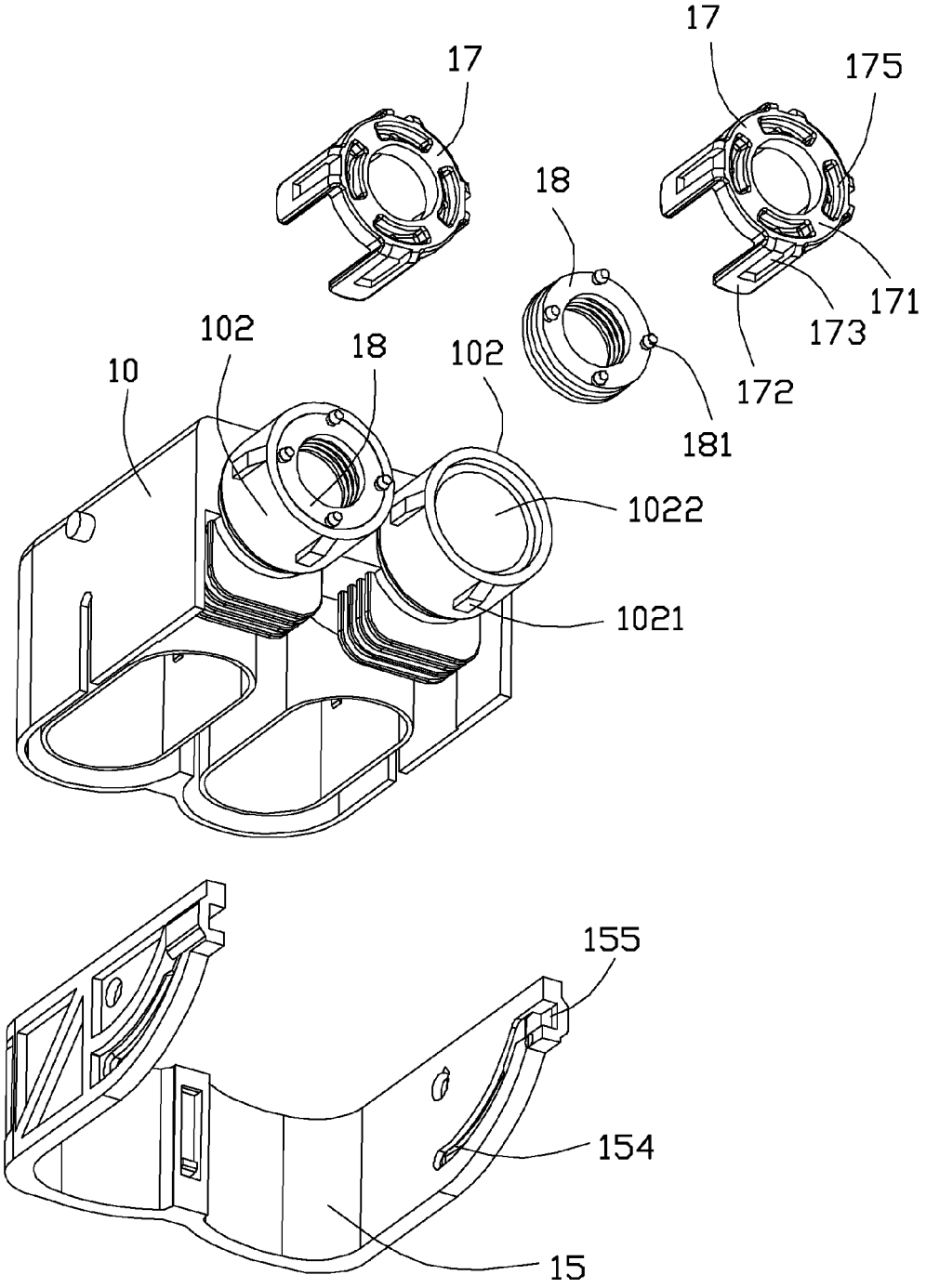

FIG. 13 is another partly enlarged perspective view of the male connector of FIG. 7, while further exploded.

Figure 14:
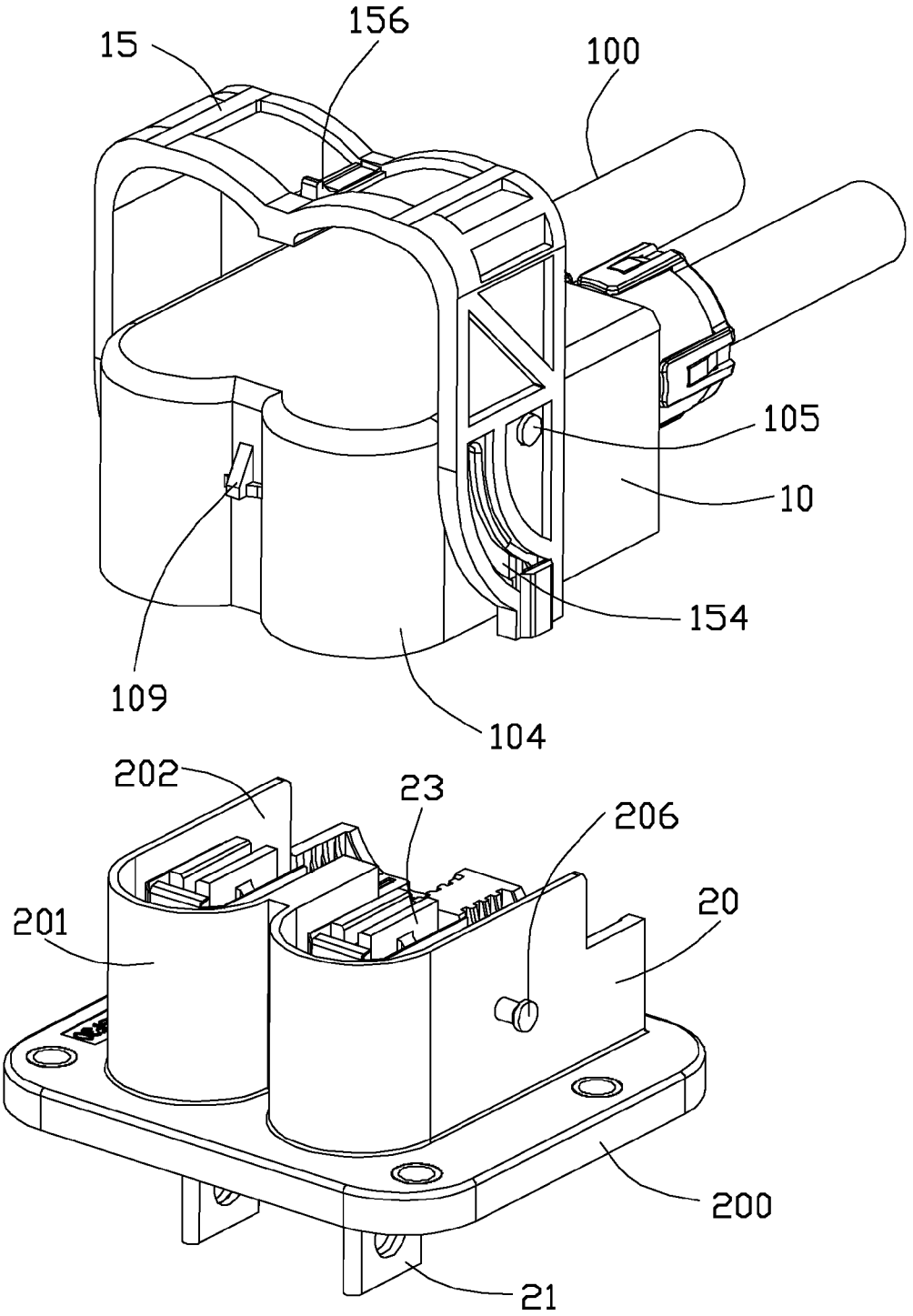

FIG. 14 is a perspective view showing the male connector being going to mate with the female connector, with the locking lever rotated to an open state.

Figure 15:
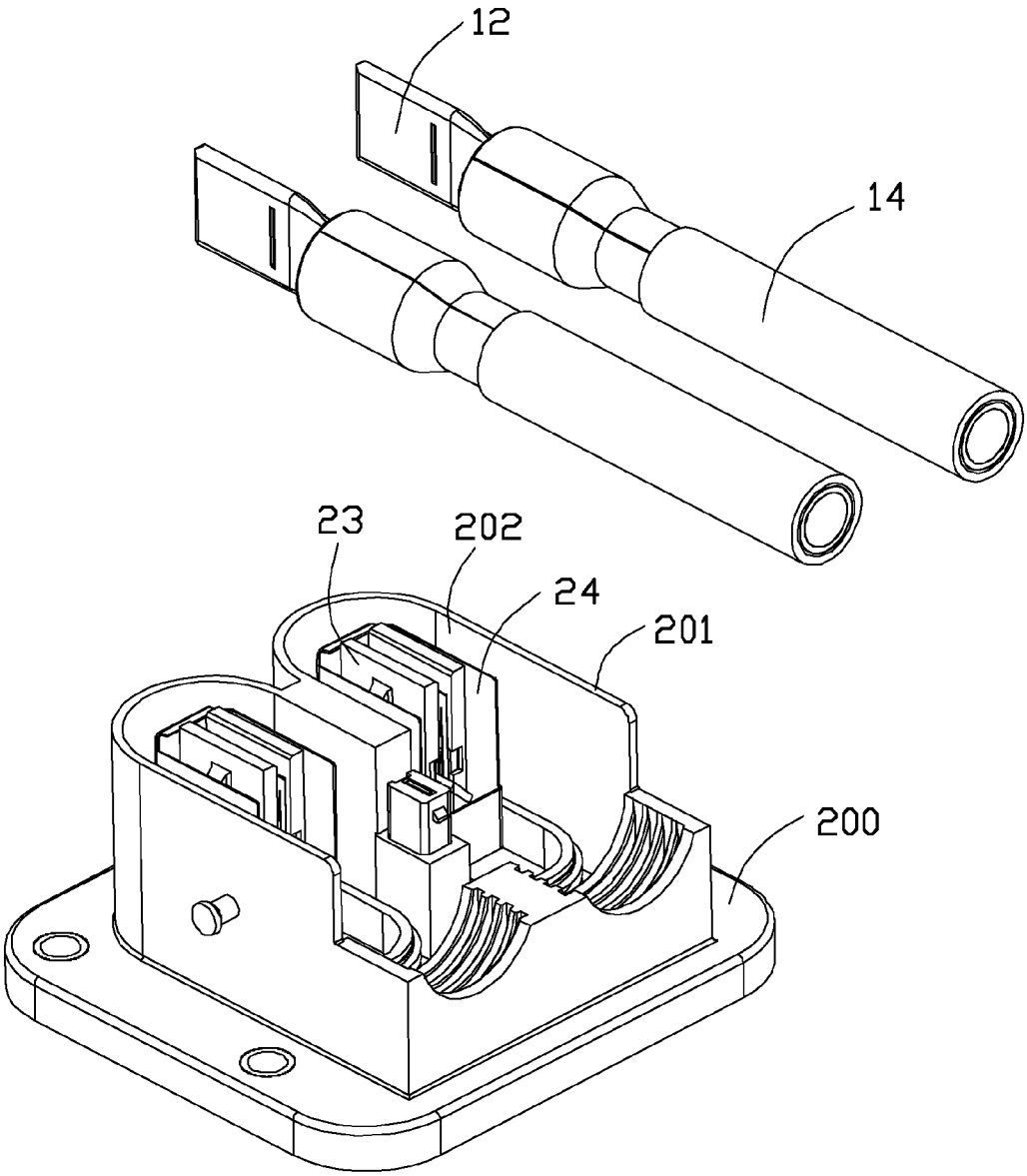

FIG. 15 is a perspective view showing how the male contacts of the male connector is going to be inserted into the female connector shown in FIG. 10.

Figure 16:
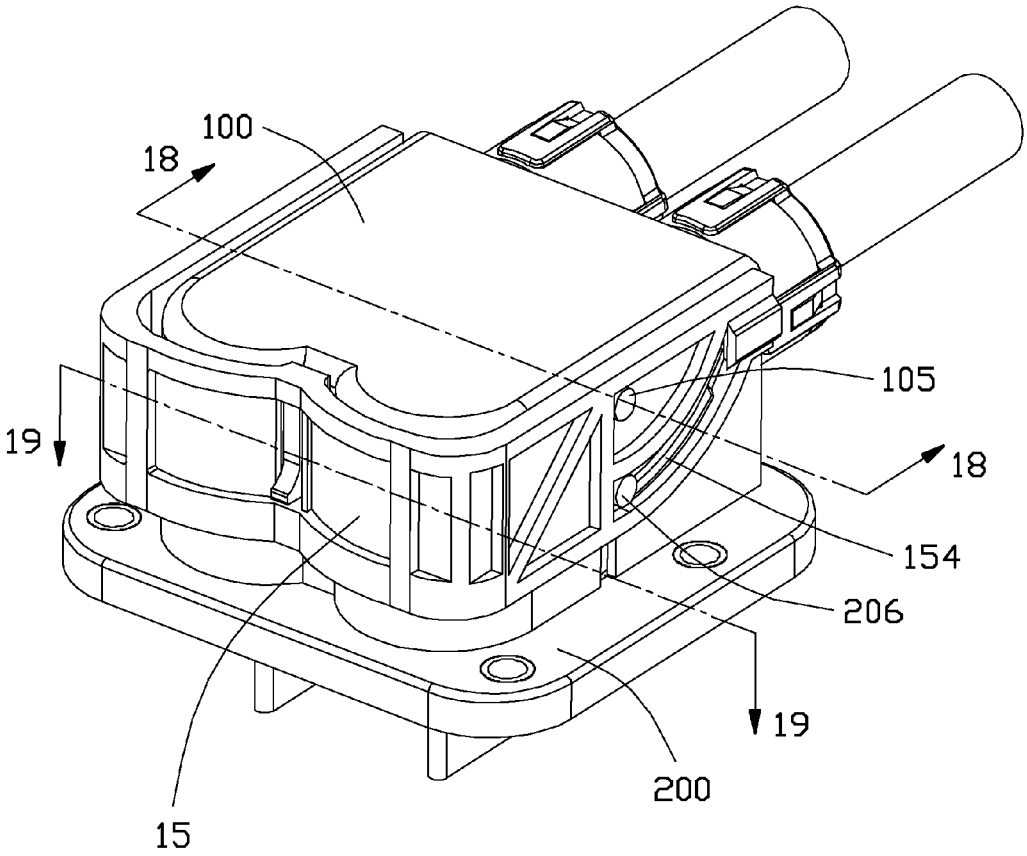

FIG. 16 is a perspective view of the mated connector assembly.

Figure 17:
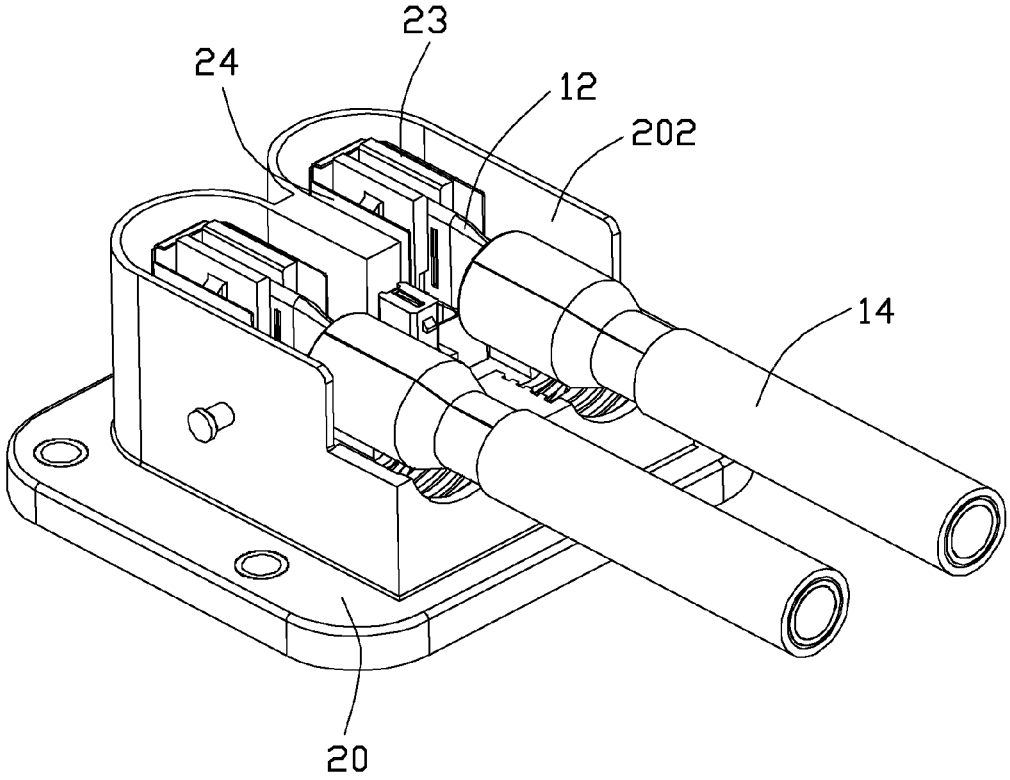

FIG. 17 is a perspective view showing how the male contacts of the male connector engage with the female connector shown in FIG. 16.

Figure 18:
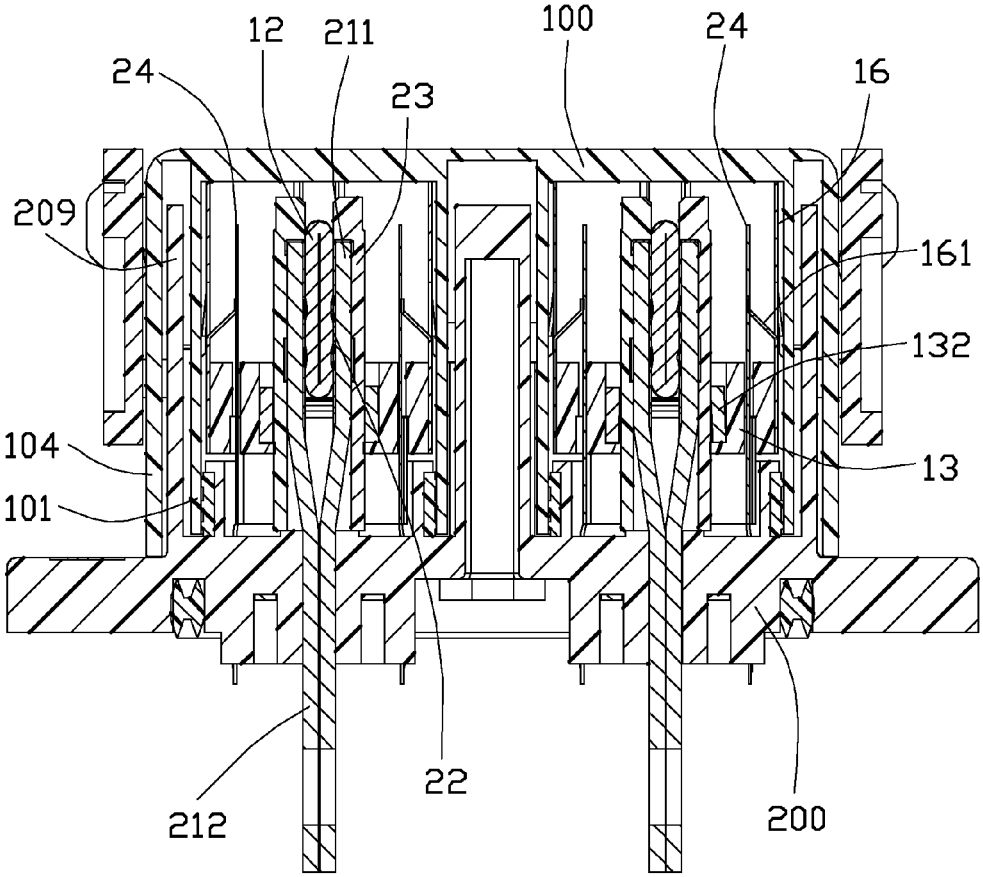

FIG. 18 is a cross-sectional view of the mated connector assembly taken along line 18-18 show in FIG. 12.

Figure 19:
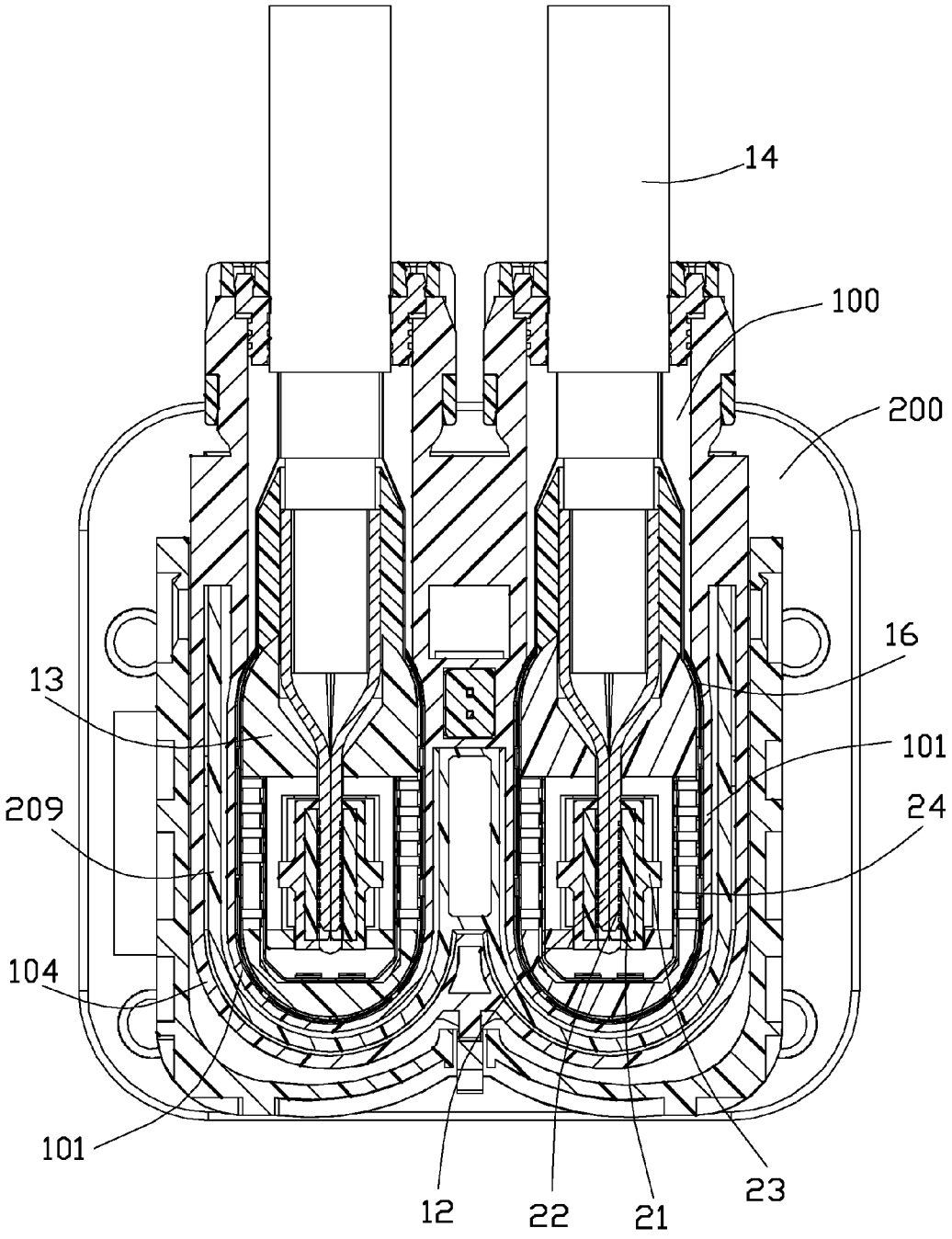

FIG. 19 is a cross-sectional view of the mated connector assembly taken along line 19-19 shown in FIG. 16.

DETAILED DESCRIPTION OF THE PREFERRED EMBODIMENT

Figure 2:
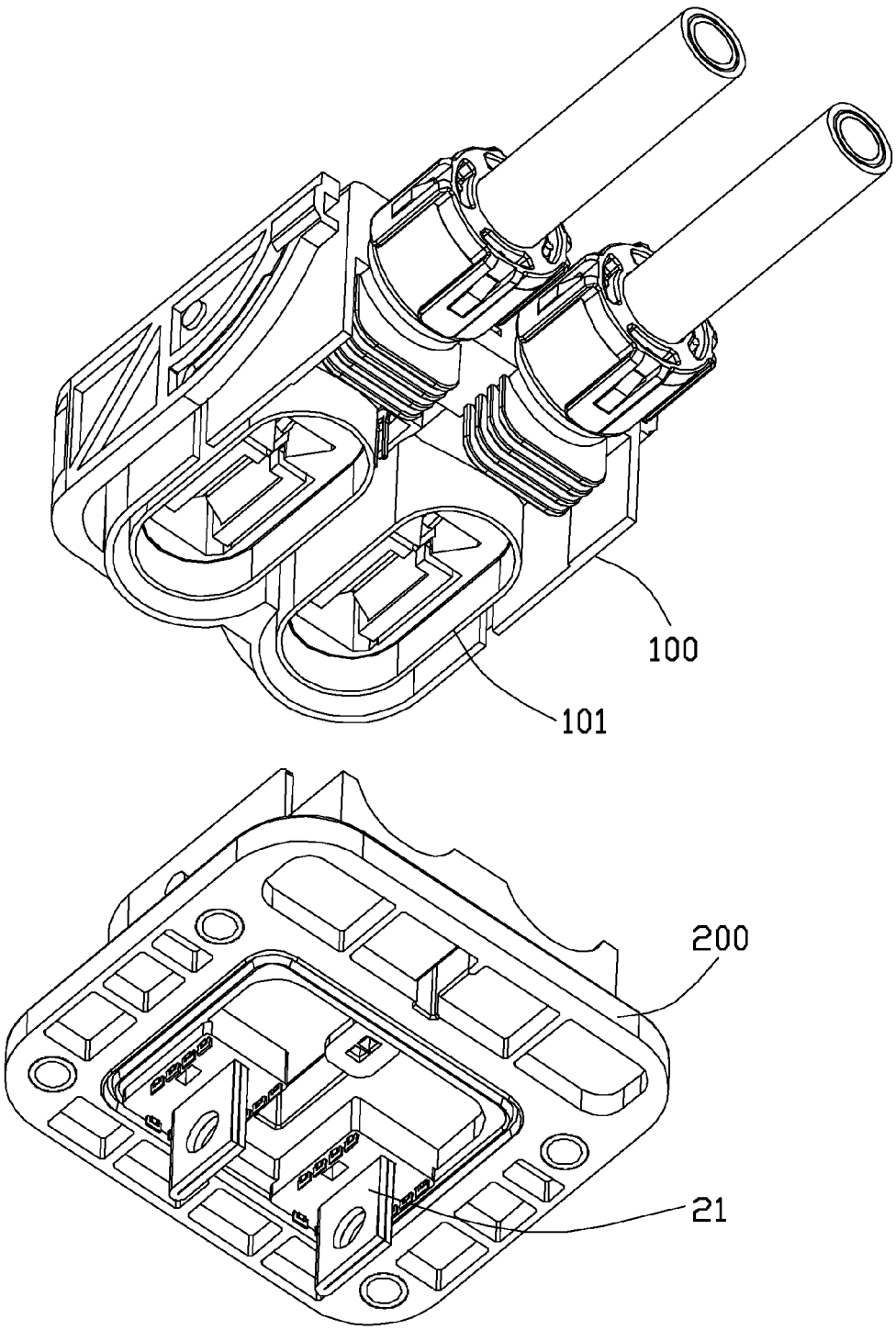
FIG. 2 is another perspective view of the unmated connector assembly shown in FIG. 1.
Figure 3:
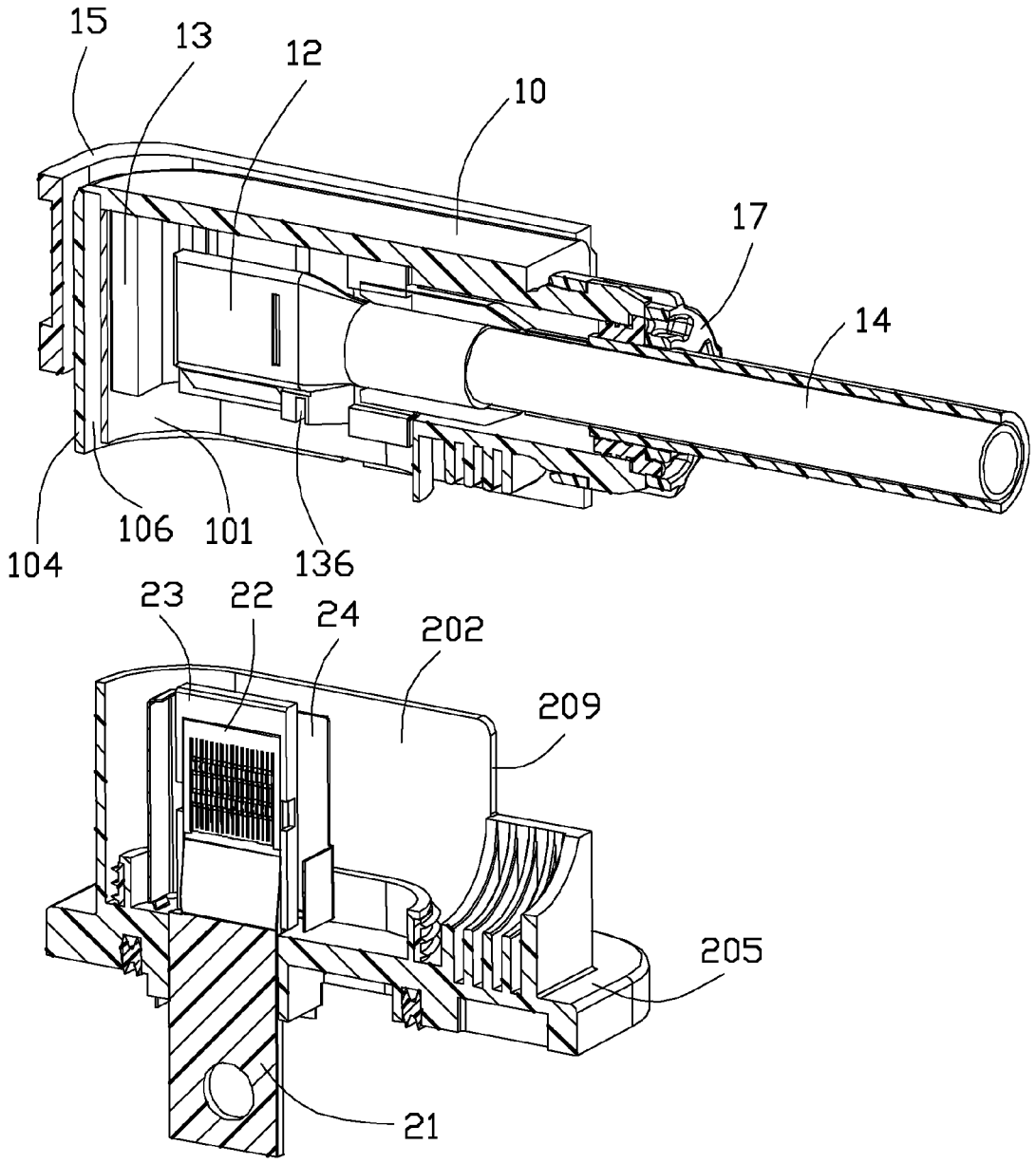
FIG. 3 is a sectional perspective view of the unmated connector assembly taken along line 3-3 show in FIG. 1.
Figure 4:
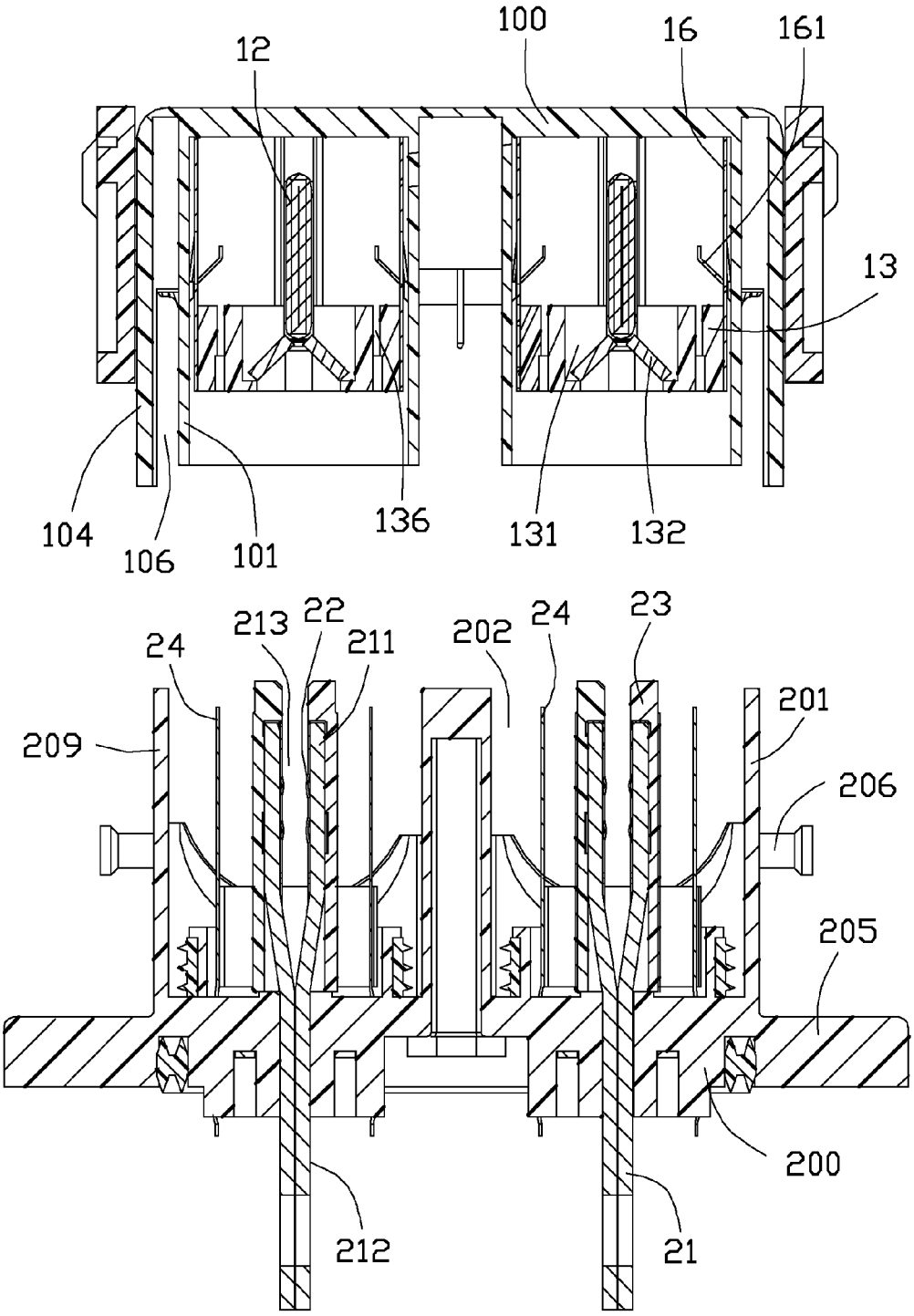
FIG. 4 is a cross-sectional view of the unmated connector assembly taken along line 4-4 show in FIG. 1.
Figure 5:
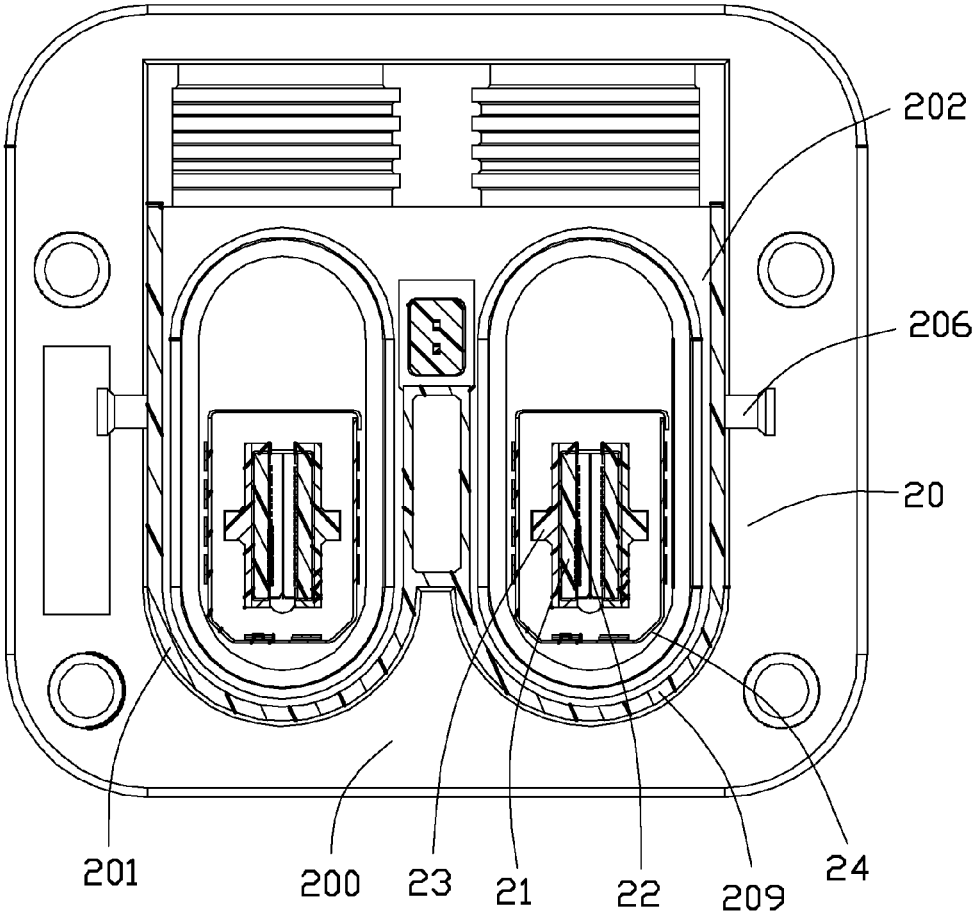
FIG. 5 is a cross-sectional view of the female connector taken along line 5-5 show in FIG. 1.

Referring to FIGS. 1-3, a connector assembly including complementary male connector 100 and female connector 200 is described herein after. The connector assembly may be in particular a high-voltage (HV) connector assembly which can be used in hybrid, battery and/or fuel-cell vehicles, and connected electrically to devices such as batteries, electric motors, etc.

Referring to FIGS. 1-3 and 9-13, The male connector 100 includes a male housing 10, a pair of blade male contacts 12, a pair of retainers 13 assembled to the male housing 10 and retaining the respective male contacts 12, a pair of cables 14 retained in the respective retainers 13 and connecting to the respective male contacts 12, and a locking lever 15 pivotably mounted onto the male housing 10.

Said male housing 10 includes a pair of oval plug portions 101 protruding downwardly therefrom, an enclosure 104 surrounding the pair of plug portions 101, and a slot 106 formed between the plug portions 101 and the enclosure 104. Each plug portion 101 defines an oval groove 103 formed thereon and facing downwardly.

The retainers 13 are received in the respective grooves 103 and have cavities 131 passing therethrough in an up-to-down direction for receiving the respective male contacts 12. Each retainer 13 has a pair of doors 132 rotatably mounted on a lower side thereof for alternatively shielding or exposing said cavity 131, a pair of notches 135 formed on two sides thereof and communicating with the cavity 131, a channel 136 passing therethrough and communicating with the notches 135, a mounting hole 133 formed on a rear end thereof and communicating with the cavity 131 for retaining the cable 14.

The male connector 100 further comprises a pair of metal shells 16 enclosing said respective retainers 13 for electrically shielding said male contacts 12, and a pair of fasteners 17 fastening said cables 14 onto said male housing 10. Each retainer 13 has a set of elastic element 134 disposed on periphery thereof to resiliently resist said metal shell 16 so that the retainer 13 and metal shell 16 could combine together firmly. Each metal shell 16 has a set of first clips 161 protruding inwardly through the respective notch 135 and into the cavity 131, and a set of second clips 162 protruding outwardly to resist embossments 108 formed on the respective plug portion 101. A mounting groove 163 is formed on a rear end of the metal shell 16 and corresponding to the mounting hole 133.

The male housing 10 has a pair of circular hollow projections 102 protruding backwardly and defining a set of ribs 1021 formed at periphery thereof. A pair of gaskets 18 are assembled to circular holes 1022 of said projections 102 to clamp the respective cables 14. Each fastener 17 has a main body 171 with said cables 14 passing through and a set of claws 172 protruding forwardly form said main body 171. Said claws 172 define retaining holes 173 latched onto said ribs 173 so that the fasteners 17 could fixed to said projections 102 firmly. Each main body 171 defines a set of receiving grooves 175 to receive bumps 181 formed at back side of the gasket 18. The locking lever 15 presents as a U shape and has a pair of through holes 152 pivotably around a pair of shafts 105 formed on two lateral sides of the enclosure 104 so that the locking lever 15 could rotate around the male housing 10. The locking lever 15 has a pair of arcuate holes 154 each defining a passageway 155 open to an rear end of the male housing 10, and a resilient bolt 156 formed in a depression 157 thereof to latch a protrusion 109 protruding at a front end of the enclosure 104.

In assembly of the male connector 100, combine the respective metal shells 16 and retainers 13 together, and install them into the respective grooves 103, the second clips 162 of the metal shells 16 resist the embossments 108 of the male housing 10 so as to fix the metal shells 16 into the grooves 103 firmly. The male contacts 12 connecting with the respective cables 14 enter into the respective plug portions 101 of the male housing 10, pass through the fasteners 17 and gaskets 18, the mounting grooves 163 of the metal shell 16, the mounting holes 133 of the retainers 13, and finally retained in the cavities 13 of the retainers 13. Mount the fasteners 17 onto the projections 102 to fix the cables 14 onto the male housing 10. Finally, assemble the locking lever 15 to the male housing 10, the holes 152 of the locking lever 15 pivotably engage with the shafts 105 of the enclosure 104.

Referring to FIGS. 1-8, the female connector 200 comprises a female housing 20, a pair of female contacts 21 retained in the female housing 20, two pairs of planar spring leaves 22 coupled to said female contacts 21, two pairs of protection boards 23 attached to said female contacts 21 and spring leaves 22.

The female housing 20 has a base 205, a pair of reception portions 201 protruding upwardly from said base 205 and integrally connecting to each other, and a pair of raised portions 206 protruding from two sides of the reception portions 201. Each reception portion 201 defines a chamber 202 for accepting the respective plug portion 101 of the male connector 100 and a peripheral wall 209 surrounding the chamber 202 in an open-ended manner.

Each female contact 21 defines a mating portion having a pair of mating plates 211 protruding into the respective chamber 202, a mounting portion opposite to said mating portion and having a pair of mounting plates 212 extending beyond said base 205. Each pair of mating plates 211 are spaced from each other in a face-to-face manner and form a receiving space 213 therebetween. Each mating plate 211 defines a set of holes 215 passing therethrough. Each pair of mounting plates 212 snuggle with each other in a face-to-face manner, and integrally connect to each other at lateral sides thereof. Each pair of mounting plates 21 define a pair of circular apertures 214 passing therethrough and aligning to each other.

The two pairs of spring leaves 22 are assembled to inner sides of the respective mating plates 21 and received in the respective receiving spaces 213. Each spring leaf 22 includes a plurality of spring fingers 221 extending along the respective mating plates 21 in said mating direction, a hook 222 at upper ends of said spring fingers 221 and bending outwardly to clasp an upper end of the corresponding mating plate 21, a pair of legs 223 extending at two lateral sides of said spring fingers and defining two latches 224 locking onto two lateral sides of the respective mating plate 21. Said spring fingers 221 of each spring leaf 22 are spaced from each other at intervals in a traverse direction and connected by two bars 225 at two opposite ends of said spring fingers 221 in said mating direction so as to prevent the spring fingers 221 from deformation and improve elastic strength of the spring leaf 22. Each spring finger 221 defines a pair of convex portions 226 disposed along said mating direction and protruding into the receiving space 213. In other embodiments of this invention, said spring leaves 22 could also be integrally coupled to said mating plates 21. In this invention the spring leaves 22 are designed to meet the requirements for t-rise and current capability, when the spring leaves 22 and female contacts 20 are separated from each other and made from different materials, the female contacts 20 may use less expensive materials and thus the project of this invention would be much more cost effective.

Each protection board 23 has a pair of barbs 231 retained in a cave 207 of said female housing 20, a groove 232 for receiving said mating plate 21 land spring leaf 22, and a set of posts 233 are formed in said groove 232 for being retained into said holes 215 of the mating plate 211. Said protection board 23 holds the respective mating plate 211 and spring leaf 22 together so as to combine the mating plate 211 and spring leaf 22 firmly. Each protection board 23 further has a pair of gaps 234 receiving said latches 224 therein.

Said female connector 200 further comprises a pair of shielding shells 24 received in the respective chambers 202 and surrounding the respective pair of protection boards 23. Said shielding shell 24 defines a set of feet 241 retained in said female housing 20 and a cutout 242 for accepting said male connector 100.

Referring to FIGS. 14-19, when said male connector 100 is being plugged into said female connector 200, the locking lever 15 is rotated to an open state of a vertical situation perpendicular to said male housing 10, said raised portions 206 of the female connector 200 pass through the respective passageways 155 and enter into the respective arcuate holes 154 of the locking lever 15 such that the arcuate holes 154 of the locking lever 15 can engage the raised portions 206 of the female connector 200. Especially referring to FIG. 16 of the "plugged state" connector assembly, by subsequent actuation and pivoting of the locking lever 15 from the open state to a close state of a horizontal situation, the male connector 100, owing to the arcuate holes 154 which cooperate with the raised portions 206, can be drawn towards the female connector 200 and fixed thereto, the resilient bolt 156 latches onto the protrusion 109 of the male housing 10 so as to prevent the locking lever 15 from vibration. Therefore, the male connector 100 and female connector could connect with each other reliably.

Referring to FIGS. 17-19, the plug portions 101 are inserted into said chambers 202 of the reception portions 201, the peripheral walls 209 of the reception portions 201 enter into the slot 106 of the male housing 10 so that the enclosure 104 could fully enclose the reception portions 201, the enclosure 104 of the male housing 10 further define a pair of recesses 107 for said raised portions 206 passing through. The protection boards 23 push away the doors 132 of the retainer 13 and enter into the cavities 131. Said male contacts 12 enter into the receiving spaces 213 of the female contacts 21 and are sandwiched between the respective spring leaves 22, the convex portions 226 of said spring fingers 221 resist the respective male contacts 12 so as to promote reliability of electrical connection between the male connector 100 and the female connector 200. The protection boards 23 hold the respective mating plates 211 and spring leaves 22 so as to prevent them from outward deformation. The shielding shells 24 engage with the respective channels 136 so as to shielding the male and female contacts 12, 21 from electromagnetic interference. Furthermore, the first clips 161 resist the shielding shell 24 so as to make electrical connections between the respective shielding shells 24 and metal shells 16.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A connector assembly comprising:

a male connector including a male housing and a plurality of male contacts for connecting to electric cables;

a female connector for mating with said male connector including a female housing and a plurality of female contacts retained in said female housing, each female contact defining a pair of mating plates spaced away from each other to sandwich said male contact therebetween; and a pair of spring leaves each defining a plurality of spring fingers and located between the male contact and the corresponding mating plate of the female contact;

wherein said spring leaves are assembled to the corresponding mating plates; said female connector further comprises a pair of protection boards retained in said female housing and attaching to each pair of said mating plates; each protection board has a groove receiving the corresponding mating plate and spring leaf, and a set of posts being retained into a set of holes formed at said mating plate.

2. The connector assembly as claimed in claim 1, wherein each pair of said spring leaves extend along said mating plates in a mating direction of said connector assembly, each spring finger defines a pair of convex portions disposed in the mating direction and resisted between the respective male contact and mating plate.

3. The connector assembly as claimed in claim 2, wherein said spring fingers of each spring leaf are spaced from each other at intervals in a traverse direction perpendicular to said mating direction and connected by two bars at two opposite ends of said spring fingers in said mating direction.

4. The connector assembly as claimed in claim 1, wherein each spring leaf includes a hook clasping a free end of the corresponding mating plate, and a pair of legs extending at two lateral sides of said spring fingers and defining two latches locking onto two lateral sides of said corresponding mating plate.

5. The connector assembly as claimed in claim 1, wherein said female connector further comprises a shielding shell surrounding the corresponding pair of protection boards, said shielding shell defines a set of feet retained in said female housing and a cutout for said male connector passing through.

6. The connector assembly as claimed in claim 5, wherein said male connector further comprises a set of retainers retaining said male contacts, and metal shells enclosing said retainers respectively; each retainer defines a cavity receiving the respective male contact and mating plates, and a channel accommodating the shielding shell of the female connector; each metal shell defines at least one clip protruding inwardly and resisting the respective shielding shell.

7. The connector assembly as claimed in claim 1, wherein said male connector further comprises a locking lever mounted onto said male housing and pivotably around a pair of shafts formed at two lateral sides of said male housing, said locking lever has a pair of arcuate holes formed at two lateral sides thereof for engaging a pair of raised portions formed at said female housing so as to actuating said male connector moving toward or away from said female connector.

8. A female connector comprising:

a female housing defining a pair of chambers;

a pair of female contacts retained in said female housing and accommodated in said pair of chambers respectively, each female contact having a pair of mating plates protruding into the corresponding chamber and spaced from each other in a face-to-face manner;

a pair of planar spring leaves coupled to each pair of said mating plates, each one of said pair of spring leaves comprising a plurality of spring fingers relaying on inner sides of the corresponding mating plates and protruding toward another of said pair of spring leaves; and two pairs of protection boards accommodated in said chambers respectively to firm said spring leaves and corresponding female contacts together.

9. The female connector as claimed in claim 8, wherein each spring leaf includes a hook clasping a free end of the corresponding mating plate, each protection board has a groove hosting the corresponding mating plate and spring leaf.

10. The female connector as claimed in claim 9, wherein each protection board has a set of posts being retained into a set of holes formed at said mating plate; each spring leaf has a pair of legs extending at two lateral sides of said spring fingers and defining two latches locking onto two lateral sides of said corresponding mating plate, each protection board has a pair of gaps for receiving said latches.

11. The female connector as claimed in claim 8, wherein said female connector further comprises a pair of shielding shells received in the respective chambers and surrounding the protection boards respectively, said shielding shell defines a set of feet retained in said female housing.

12. An electrical connector assembly comprising:

a receptacle connector including:

a first insulative housing assembly defining a mating cavity upwardly exposed to an exterior in a vertical direction;

a pair of contacting plates disposed in the mating cavity and facing to each other in a first transverse direction perpendicular to said vertical direction;

a first metallic shielding shell disposed in the mating cavity and enclosing said pair of contacting plates;

a plug connector including:

a second insulative housing assembly defining a receiving cavity downwardly exposed to an exterior;

a single contacting blade disposed in the receiving cavity;

a second metallic shielding shell disposed in the receiving cavity and enclosing said single contacting blade;

a cable connected to the single contacting blade extending through said second metallic shielding shell and out of the second housing along a second transverse direction perpendicular to both said vertical direction and said first transverse direction; wherein the single contacting blade extends in a plane defined by both said vertical direction and said second transverse direction; wherein during mating the plug connector with the receptacle connector along the vertical direction, the first metallic shielding shell and the pair of contacting plates are commonly received within the receiving cavity, the signal contacting blade is snugly sandwiched between the pair of contacting plates in the first transverse direction, and the first metallic shielding shell is enclosed within and mechanically and electrically connected to said second metallic shielding shell.

13. The electrical connector assembly as claimed in claim 12, wherein the second housing assembly forms a channel to receive said first metallic shielding shell during mating.

14. The electrical connector assembly as claimed in claim 12, wherein the second metallic shielding shell forms a plurality of inward extending spring arms to mechanically and electrically contact the first metallic shielding shell during mating.

15. The electrical connector assembly as claimed in claim 12, wherein said second insulative housing assembly includes an insulative main body, and an insulative retainer enclosed and retained within the second metallic shielding shell, and the pair of contacting plates and the first metallic shielding shell are commonly received within the retainer during mating, and the main body defines a downward facing space to allow the assembled second metallic shielding shell and insulative retainer to be upwardly assembled into the space along the vertical direction while said main body further defines a passage to allow the cable with the associated single contacting blade to extend therethrough, along the second transverse direction, with the single contacting blade entering said insulative retainer.

16. The electrical connector assembly as claimed in claim 15, further including a fastener defining a set of claws latching onto said insulative main body to secure the cable to the housing.

17. The electrical connector assembly as claimed in claim 12, wherein each of said contacting plates is not directly fixed to the first insulative housing but being attached to a protection board which is fixed to the first insulative housing, and each of said contacting plates is equipped with a planar spring leaves fixed to the corresponding protection board and facing toward the other of said pair of contacting plates.

18. The electrical connector assembly as claimed in claim 12, wherein the second insulative housing assembly forms a circumferential slot to receive a peripheral wall of the first insulative housing assembly during mating.

* * * * *